US012305549B2

(12) United States Patent
Salvadori et al.

(10) Patent No.: US 12,305,549 B2
(45) Date of Patent: May 20, 2025

(54) HEAT SHIELD FOR EXHAUST SYSTEM

(71) Applicant: AGCO International GmbH, Neuhausen (CH)

(72) Inventors: David Salvadori, Beauvais (FR); Christophe Leonard, Beauvais (FR); Valentin Bousselet, Beauvais (FR)

(73) Assignee: AGCO International GmbH, Neuhausen (CH)

( * ) Notice: Subject to any disclaimer, the term of this patent is extended or adjusted under 35 U.S.C. 154(b) by 0 days.

(21) Appl. No.: 18/844,630

(22) PCT Filed: Feb. 16, 2023

(86) PCT No.: PCT/IB2023/051402
§ 371 (c)(1),
(2) Date: Sep. 6, 2024

(87) PCT Pub. No.: WO2023/180827
PCT Pub. Date: Sep. 28, 2023

(65) Prior Publication Data

US 2025/0109705 A1 Apr. 3, 2025

(30) Foreign Application Priority Data

Mar. 25, 2022 (GB) ..... 2204215

(51) Int. Cl.
*F01N 13/08* (2010.01)

(52) U.S. Cl.
CPC ..... *F01N 13/08* (2013.01)

(58) Field of Classification Search
CPC ..... F01N 2260/20; F01N 2260/022; F01N 13/085; F01N 2590/08; F01N 2260/26;
(Continued)

(56) References Cited

U.S. PATENT DOCUMENTS 3,047,109 A * 7/1962 Holopainen ..... E02F 3/384 280/460.1
9,816,758 B2 * 11/2017 Gismervik ..... F01N 13/18
(Continued)

FOREIGN PATENT DOCUMENTS

EP 3569837 A1 * 11/2019 ..... F01N 13/008
EP 3569837 B1 5/2021
(Continued)

OTHER PUBLICATIONS

UK Intellectual Property Office, Search Report for related UK Application No. GB2204215.4, dated Aug. 30, 2022, 3 pages.
(Continued)

*Primary Examiner* — James A Shriver, II
*Assistant Examiner* — Hilary L Johns

(57) ABSTRACT

The shield has a housing enclosing part of the exhaust system and including air vents to enable hot air from the exhaust to escape from the housing. A base of the housing includes a tiered discharge plate arrangement having at least two tiers of vertically spaced plates. The tiered arrangement has a lower tier in the form of a continuous plate and an upper tier vertically spaced above the lower tier which has a large opening allowing debris which has entered the shield to fall onto the lower tier for discharge from the housing over a first edge of the lower tier through a first gap between the first edge and an adjacent wall of the housing. The upper tier has a second edge which overhangs the first gap at least partially covering the gap to prevent debris from entering the housing from below.

13 Claims, 5 Drawing Sheets

(58) Field of Classification Search
CPC ..... F01N 13/08; F01N 13/141; F01N 13/18; F01N 13/14; F01N 13/1816; F01N 13/1822; F01N 13/009; F01N 13/1805; F01N 13/1811; B60K 13/04; B60Y 2200/22
USPC ..... 180/89.1
See application file for complete search history.

(56) References Cited

U.S. PATENT DOCUMENTS

| | | | | |
|---|---|---|---|---|
| 10,071,626 | B2 * | 9/2018 | Kuhn | F01N 13/1844 |
| 2016/0318388 | A1 * | 11/2016 | Kuhn | F01N 3/103 |
| 2018/0001762 | A1 * | 1/2018 | Nagano | B60K 13/04 |
| 2019/0195314 | A1 * | 6/2019 | Puryk | F16G 3/06 |
| 2021/0123368 | A1 * | 4/2021 | Akyildiz | F01N 3/035 |
| 2023/0323800 | A1 * | 10/2023 | Akyildiz | F01N 3/208 60/297 |

FOREIGN PATENT DOCUMENTS

| | | | |
|---|---|---|---|
| EP | 3263386 | B1 | 5/2022 |
| WO | 2010069806 | A1 | 6/2010 |

OTHER PUBLICATIONS

European Patent Office, Search Report for related PCT Application No. PCT/IB2023/051402, dated May 11, 2023, 08 pages.

* cited by examiner

HEAT SHIELD FOR EXHAUST SYSTEM

CROSS-REFERENCE TO RELATED APPLICATIONS

This application is a national phase entry under 35 U.S.C. § 371 of International Patent Application PCT/IB2023/051402, filed Feb. 16, 2023, designating the United States of America and published in English as International Patent Publication WO2023/180827 A1 on Sep. 28, 2023, which claims the benefit of the filing date of U. K. Patent Application 2204215.4, "Heat Shield for Exhaust System", filed Mar. 25, 2022, the entire disclosure of which is incorporated herein by reference.

FIELD

Embodiments of the present disclosure relate generally to heat shields for protecting hot exhaust systems of agricultural or industrial vehicles from contact with environmental debris which may result in fires or from contact with bystanders which can lead to injury during use of the vehicles.

BACKGROUND

Typically such heat shields surround part of the exhaust system and are provided with air vents to allow the hot air from the exhaust to escape but this can lead to debris entering the shield and becoming trapped and thus creating a fire risk. This problem can be particularly acute when the heat shield encloses an exhaust after treatment system which can become very hot in operation.

BRIEF SUMMARY

The present invention thus provides a heat shield for protecting part of an exhaust system of an agricultural or industrial vehicle, the shield comprising a housing enclosing said part of the exhaust system, wherein a base of the housing includes a tiered discharge plate arrangement having at least two tiers of vertically spaced plates, the tiered arrangement having a lower plate which is continuous and an upper plate vertically spaced above the lower plate which has an opening positioned vertically above the continuous lower plate, a first edge of the lower plate being spaced from an adjacent wall of the housing to define a first gap between the first edge and the adjacent wall, the upper plate having a second edge which overhangs the first edge and is spaced closer to the adjacent wall than the first edge.

Such an arrangement greatly improves the removal of debris from within the shield whether the vehicle is moving or stationary whilst still permitting a flow of air through the housing to limit the build-up of heat within the housing. Debris which has entered the housing is able to fall through the opening in the upper plate onto the continuous lower plate from where it is able to fall through the first gap to exit the housing. The overhanging portion of the upper plate at least partially covers the first gap so that debris is inhibited from entering the housing past the edges of the vertically spaced plates.

The housing may have openings or vents in an upper region to enable air heated by the exhaust to escape from the housing.

The second edge of the upper plate may be spaced from the adjacent wall to define a second gap which is smaller than the first gap. The second gap may be less than 50%, or less that 25%, or less than 12%, of the size of the first gap. Alternatively, the second edge of the upper plate may contact the adjacent wall.

The upper plate may have a continuous outer edge region which surrounds the opening and which defines the second edge. The opening may be located above the lower plate inboard of the first edge so that the continuous outer edge region overhangs the first gap. The opening may extend over 50%, or over 75%, of the cross sectional area of the upper plate. In an embodiment, the tiered discharge plate arrangement is configured such that no part of the opening extends beyond first edge of the lower plate towards the adjacent wall. This ensures that there is there is no direct path upwardly in a vertical direction through the first gap and the opening in the plate above. Thus debris would have to follow a tortuous path to enter the housing through the first gap and the opening in the plate above.

There may be three or more tiers of vertically spaced plates in which the lower plate is a continuous plate and the upper plates each have an opening surrounded by a continuous outer edge region defining a respective second edge which overhangs and extends beyond the edge of the plate in the tier below. The overhanging outer edge regions of the upper plates inhibit debris from entering the housing from below but allow debris on the upper tiers to fall through the second and first gaps to exit the housing and allow air to pass upwardly into and through the housing.

At least the lower plate of the discharge plate arrangement may slope downwardly in a direction toward the first edge. This aids discharge of the debris via the first gap. The at least the lower plate of the discharge plate arrangement may slope downwardly from the horizontal at an angle in the range of 5 to 45 degrees. All of the vertically spaced plates may slope downwardly and may be aligned parallel to one another.

The vertical spacing of the tiers may be configured depending on the size and quantity of the debris that it is expected will be required to be discharged.

The housing may also enclose an exhaust gas after treatment system.

Part of the exhaust gas treatment system may be located within the opening of the upper plate or plates.

An end of the lower plate may have a flap which extends upwardly to prevent environmental debris from entering the housing at that end of the discharge plate arrangement.

The discharge plate arrangement may be made from metal and/or plastics material.

The discharge plate arrangement may be orientated with the first and second edges located behind and spaced from a forward facing wall of the housing. Alternatively, the discharge plate arrangement may be orientated with its first and second edges located behind and spaced from sideways or rearwardly facing walls of the housing depending on the layout of the vehicle concerned. The discharge plate arrangement may be enclosed on two or more sides by walls of the housing which extend generally in an upwardly direction and which may be vertical or substantially vertical.

Within the scope of this application it should be understood that the various aspects, embodiments, examples and alternatives set out herein, and individual features thereof may be taken independently or in any possible and compatible combination. Where features are described with reference to a single aspect or embodiment, it should be understood that such features are applicable to all aspects and embodiments unless otherwise stated or where such features are incompatible.

BRIEF DESCRIPTION OF THE DRAWINGS

One or more embodiments of the disclosure will now be described, by way of example only, with reference to the accompanying drawings, in which.

DETAILED DESCRIPTION

Figure 1:
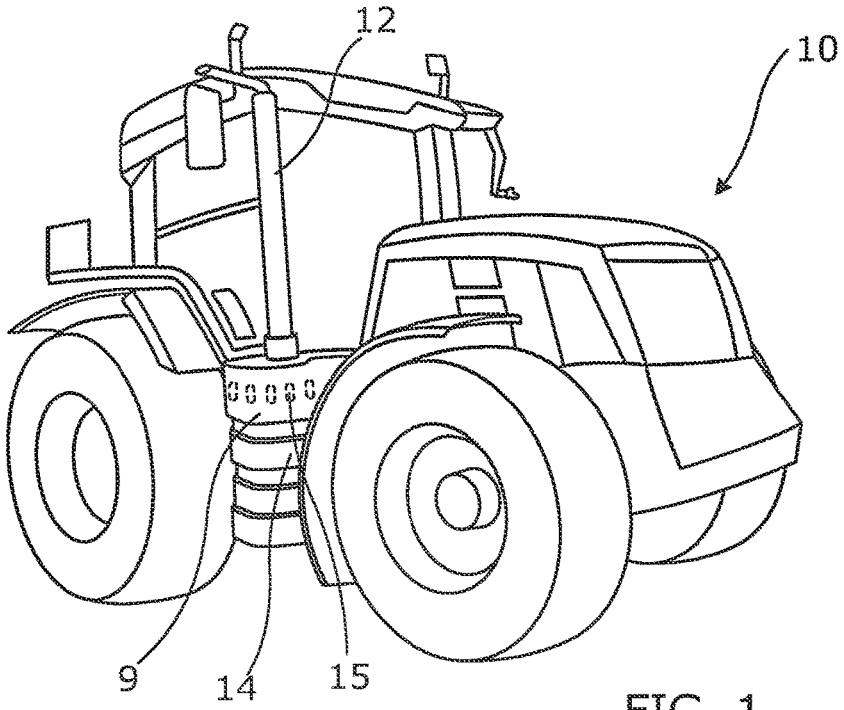
FIG. 1 shows an agricultural tractor fitted with a heat shield in accordance with the present invention enclosing the lower part of its vertical exhaust stack.
Figure 2:
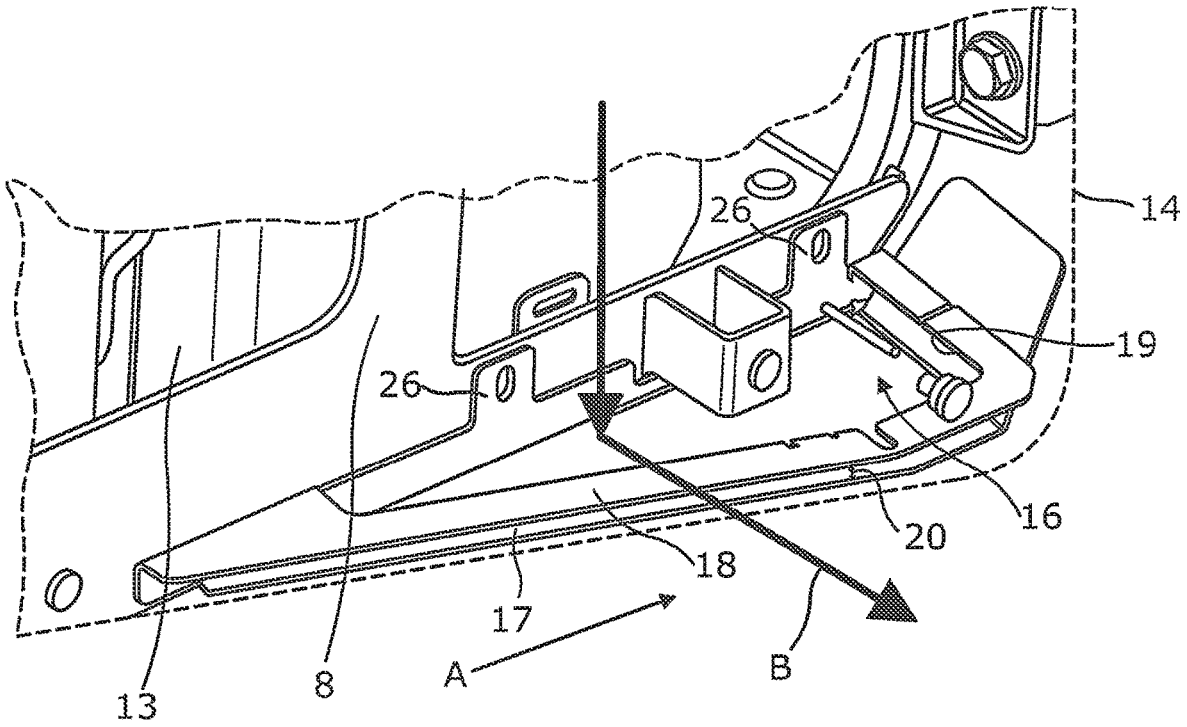
FIG. 2 shows a perspective view of part of a heat shield in accordance with the present invention showing a two tier discharge plate closing the base of the shield.

Referring to FIG. 1 this shows an agricultural tractor 10 fitted with a heat shield 11 in accordance with the present invention which has a housing 9 enclosing the lower part of a vertical section of an exhaust system 12. The heat shield housing 9 has air vents 15 and encloses a multi stage exhaust gas after treatment system (EAT) indicated generally at 13 in FIGS. 2 and 3 which may include, for example, selective catalytic reduction (SCR), diesel oxidation catalysis (DOC) and diesel particulate filtering (DPF). The heat shield housing 9 has a front facing external wall indicated at 14 in FIGS. 2, 3 and 9 and an internal wall 8 spaced rearward from the front facing wall 14. Arrow C in FIG. 3 indicates a forward direction of movement of the tractor 10.

The air vents 15 allow hot air to escape the housing 9 to reduce the build-up of heat. In alternative embodiments, the housing may not have dedicated air vents as such but gaps between components of the housing allow hot air to escape from an upper region.

Figure 3:
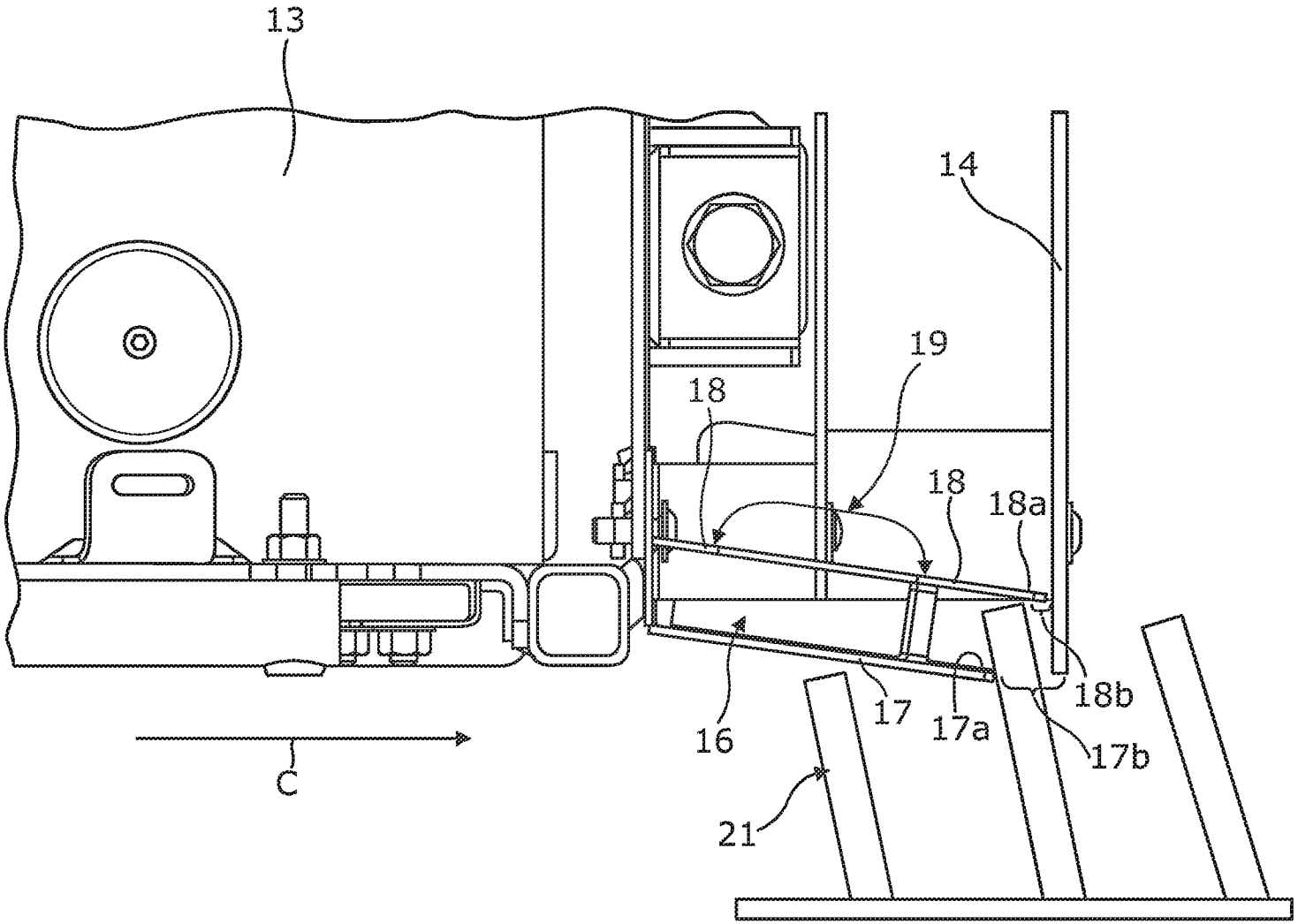
FIG. 3 shows a side view, partly in section, in the direction of the arrow A of FIG. 2.
Figure 4:
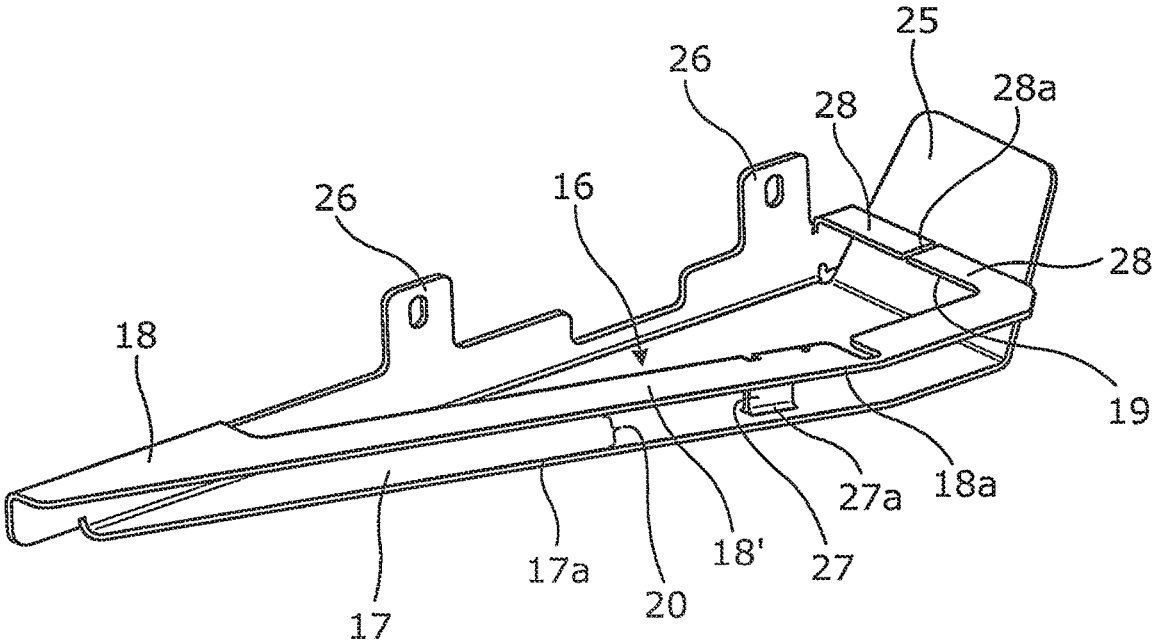
FIG. 4 shows a perspective view of the discharge plate of FIG. 2.
Figure 5:
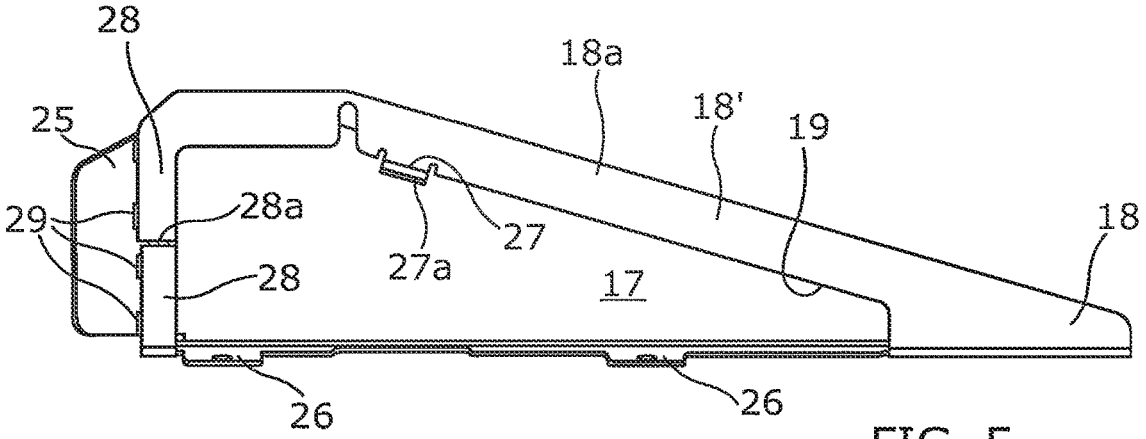
FIGS. 5, 6 and 7 show a top view, a bottom view and a side view of the discharge plate of FIG. 4.
Figure 6:
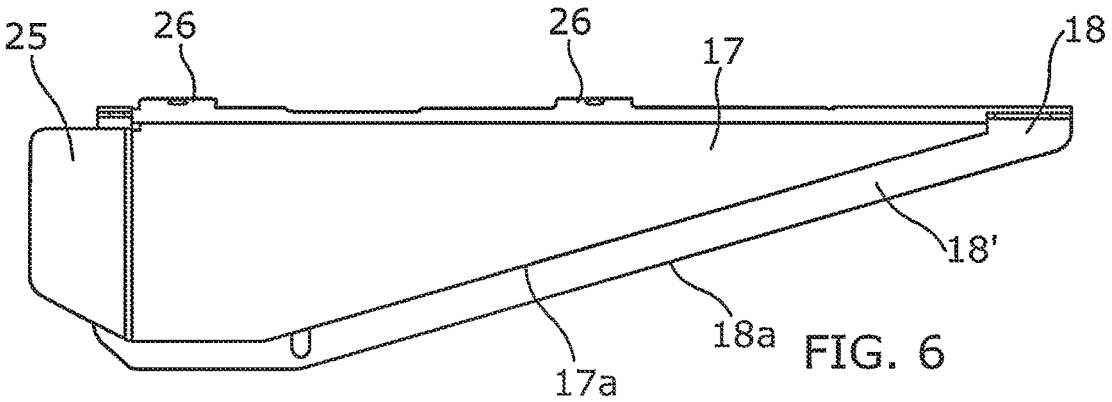
Figure 7:
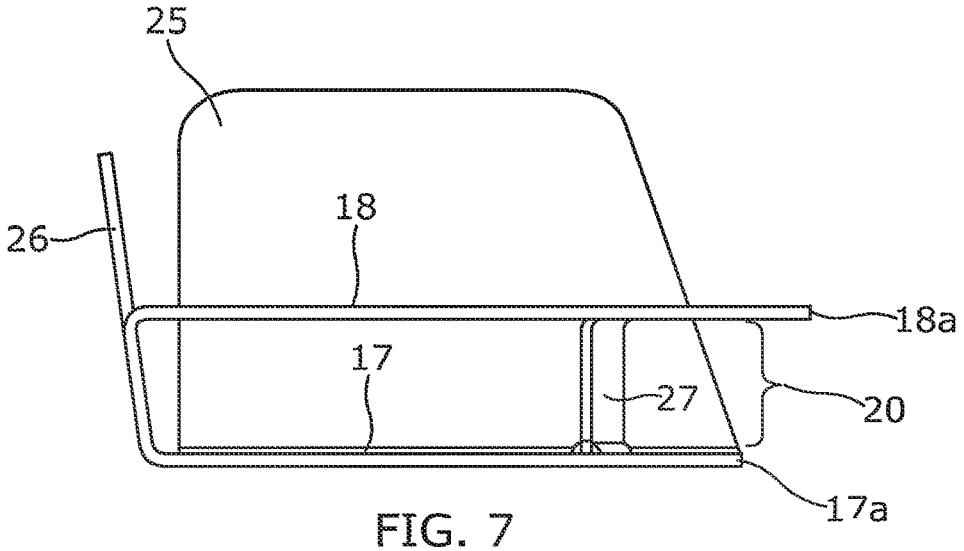

In accordance with the present disclosure, the lower end of the heat shield housing 9 is closed off by a tiered discharge plate arrangement 16. As can be seen in detail from FIGS. 4 to 7, the tiered discharge plate 16 has a lower tier in the form of a continuous bottom plate 17 and an upper tier or rim plate 18 which has a large opening 19 allowing any debris (e.g. crop material and dust) which has entered within the housing to fall onto the lower tier 17 for discharge over a first edge 17*a* of the lower tier via a first gap 17*b* between first edge 17*a* and the rear/inner face of front wall 14 of housing 9. This discharge flow is indicated diagrammatically in FIG. 2 by arrow B. The upper plate 18 has a continuous outer edge region 18' surrounding the opening 19 which overhangs the first gap 17*b* and has a second edge 18*a*. The overhanging outer edge region 18' of the upper plate 18 inhibits debris 21, for example in the form of stubble, from entering the housing from below as shown in FIG. 3. The vertical spacing 20 between the tiers is configured depending on the size/quantity of the debris which is expected to be discharged and may depend on the type of crops or environments the tractor is associated with in use.

As best seen from FIG. 3, the second edge 18*a* of the upper tier 18 is located closer to the rear of the front wall 14 of the housing than the first edge 17*a* so that there is a second gap 18*b* between the rear of front wall 14 and the second edge 18*a* which is smaller than the first gap. This second gap 18*b* allows debris on the upper plate 18 to fall through the second and first gaps 18*b*, 17*b* to exit the housing. The gaps 17*b*, 18*b* ensure that the housing 9 is not fully enclosed at the lower end so that an air flow upwardly through the housing to the vents 15 or other openings can be established but significantly inhibits debris from entering the housing 9 from below whilst also allowing debris that may have entered the housing, say through the vents 15 or other openings, to fall out of the housing. This reduces the risk of debris building up in the housing and presenting a fire risk.

Figure 8:
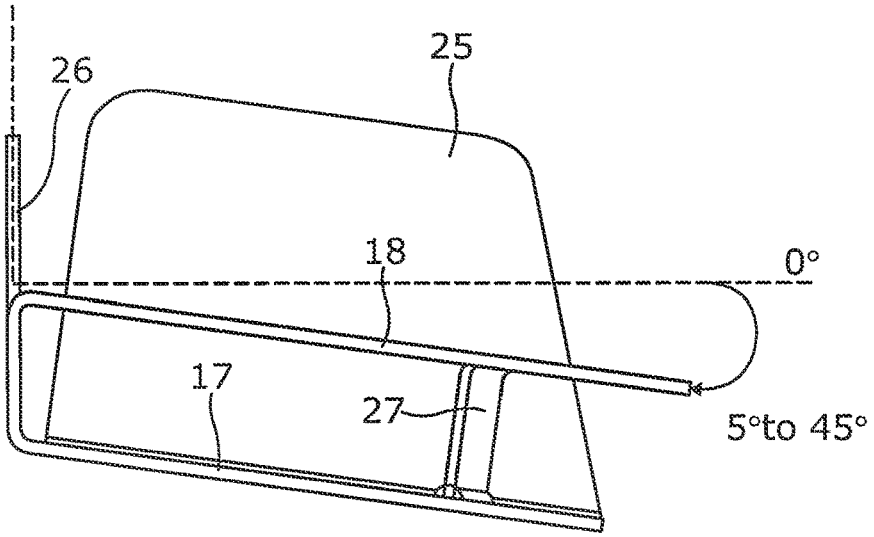
FIG. 8 is a view similar to that of FIG. 7 but showing the discharge plate aligned in its in use position with the plates inclined downwardly.

FIG. 8 shows that the tiers of the discharge plate arrangement may slope downwardly when the tractor is generally horizontal. This downward slope assists in the discharge of debris from within the housing both when the tractor is stationary or moving. Typically the downward slope from the horizontal will be in the range 5 to 45 degrees depending on the size and quantity of the debris required to be discharged. When the vehicle is stationary, vibration from the engine will still tend to dislodge debris down the inclined tiers. Whilst it may be advantageous for all the plates 17, 18 to slope at the same angle in a parallel arrangement as shown for ease of manufacture, this is not essential.

In an alternative arrangement, the tiers can be generally horizontal (i.e. downward slope is zero) or just the lower plate 17 can be angled downwardly.

Figure 9:
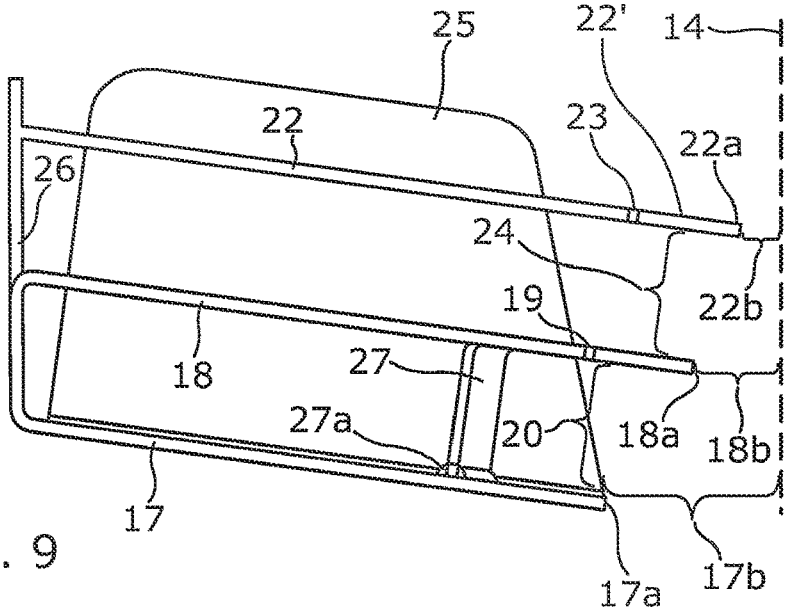
FIG. 9 is a view similar to that of FIG. 8 but showing of a discharge plate arrangement with three tiers; and, FIG. 10 is a view from below of a lower part of the heat shield showing the discharge plate in position closing the base of the shield.
Figure 10:
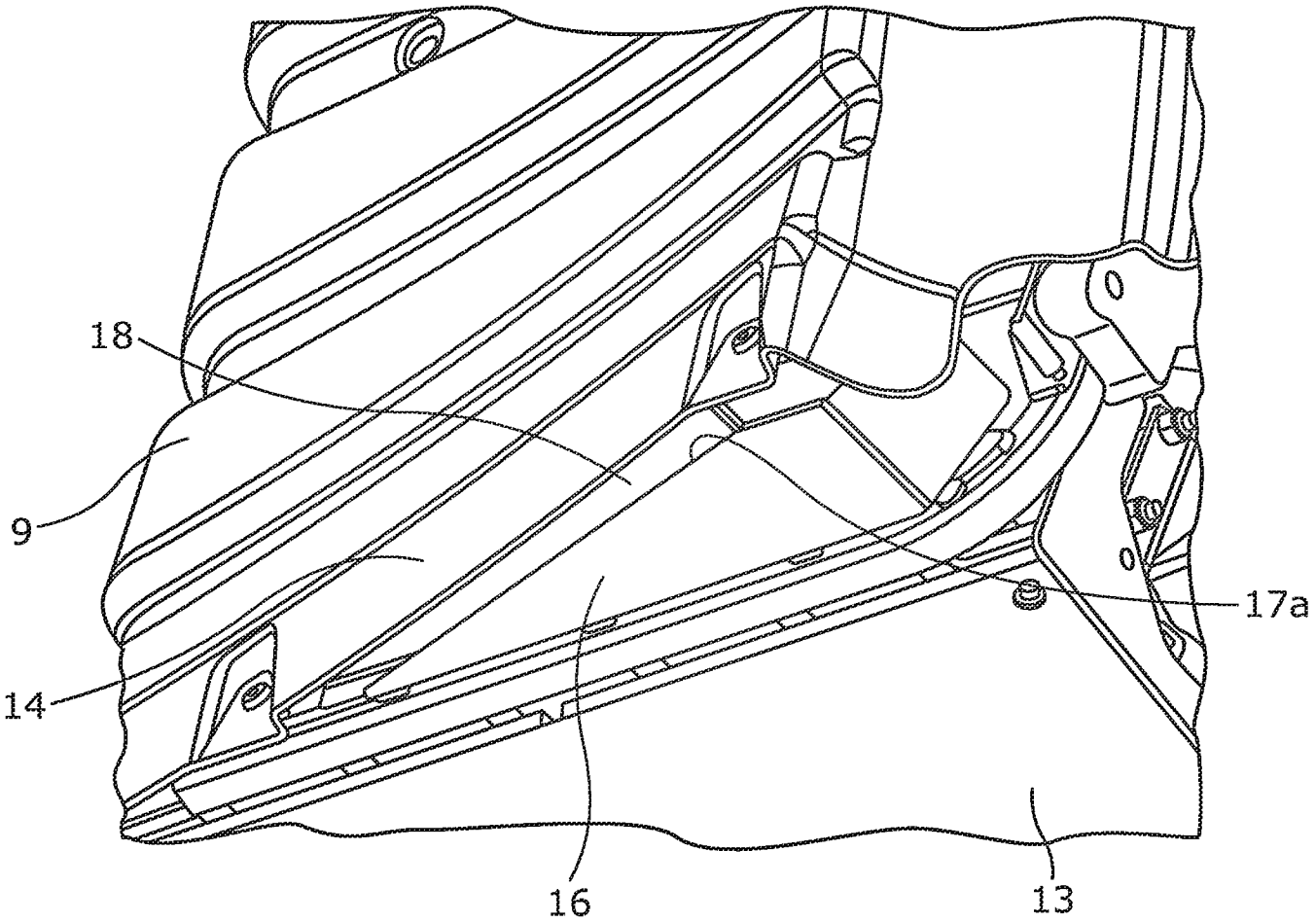

The shield may have three or more tiers as shown, for example, in FIG. 9 where a third plate 22 is added above the previously described plates 17 and 18. The uppermost plate 22 in the third tier again has a large opening 23 allowing any debris which has entered within the shield to fall onto the lower plate 17, passing through the opening 19 in the second plate 18, and thus be discharged from within the housing as previously described. Third plate 22 also has an outer edge region 22' with a second edge 22*a* which overhangs and extends beyond the edge 18*a* of the plate 18 below to define a gap 22*b* through which debris which has landed on upper plate 22 can exit from within the housing via gaps 22*b*, 18*b* and 17*b*. Upper plates 18 and 22 together restrict the ability of environmental debris to enter within the housing 9 via the lower exit gap 17*b*. The third plate 22 may be constructed in a similar manner to the second plate 18 but dimensioned appropriately.

In an embodiment, one end of the lower plate 17 has a flap 25 which extends upwardly to prevent environmental debris from entering the housing at that end of the discharge plate arrangement and two attachment tabs 26 are provided to secure the tiered discharge plate arrangement to the inner wall 8 of the housing.

The openings 19, 23 may each cover over 50%, or over 75%, of the cross sectional area of the respective plate 18, 22. The, or each, opening 19, 23 is positioned above the continuous lower plate 17 and in alignment with one another. In an embodiment, the arrangement is configured such that no part of the opening 19 in the second plate 18 extends beyond the first edge 17*a* of the lower plate 17 towards the front wall. This ensures that there is there is no direct path upwardly in a vertical direction through the first gap 17*b* and the opening 19 in the plate above. Thus debris would have to follow a tortuous path to enter the housing through the first gap 17*b* and the opening 19 in the plate 18 above. Where there are two or more upper plates 18, 22, the openings 19, 23 in the upper plates are aligned to form a passage through which debris can fall onto the lower plate 17

The first gap 17*b* is sufficiently large as to allow debris to fall through the gap. The second gap 18*b* is significantly smaller than the first gap 17*b* so that larger pieces of debris which can pass through the first gap 17*b* are unable to pass through the second gap 18*b*. The second gap 18*b* may be less than 50%, or less that 25%, or less than 12%, of the size of the first gap. In a non-limiting embodiment, the gap 17*b* may be in the range of 17 mm to 27 mm, or in the range of 19 mm to 25 mm, or in the range of 21 mm to 23 mm. In a non-limiting embodiment, the gap 18*b* may be in the range of 5 mm to 11 mm, or in the range of 6 mm to 10 mm, or in the range of 7 mm to 9 mm.

The tiered discharge plate 16 shown in FIGS. 4 to 7 can be made from a single sheet of metal by a pressing and folding operations. After the tiered arrangement has been folded to its desired configuration, turned down support lug 27 is welded to bottom plate 17 at 27*a* and ends 28 of upper tier 18 are welded together at 28*a* with flap 25 being welded to ends 28 at 29. However, the tiered discharge plate 16 can be made using any suitable method of manufacture and could be made of two or more initially separate components which are assembled or joined together.

Alternatively, the discharge plate 16 could be formed from a suitable plastics material.

The plan profile of the discharge plate 16, which is generally wedge shaped in the embodiment described above, depends on the shape of the aperture at the base of the shield which the discharge plate has to close off. This will determined by such issues as whether the shield is covering an EAT system as described above. Accordingly, the first and second edges may be of any shape complementary to the shape of the housing.

In the arrangement described above, the discharge plate 16 is fitted in front of the exhaust after treatment system 13 with the first and second edges 17*a* and 18*a* located behind and spaced from a forward facing wall of the housing 14. Alternatively, in different vehicle applications, the discharge plate arrangement may be orientated with its first and second edges located behind and spaced from sideways or rearwardly facing wall 14 of the housing depending on the layout of the vehicle concerned. The first and second edges 17*a* and 18*a* located behind and spaced from a wall having portions which face in different directions or from two adjacent walls which face in different directions.

The design of the discharge plate arrangement 16 allows space to be saved within the shield by allowing part of the EAT system to extend into part of the large openings 19, 23 in the upper tier or tiers 18, 22.

What is claimed is:

1. A heat shield for protecting part of an exhaust system of an agricultural or industrial vehicle, the heat shield comprising:

a housing for enclosing the part of the exhaust system, wherein a base of the housing includes a tiered discharge plate arrangement having at least two tiers of vertically spaced plates, the tiered arrangement having a lower plate which is continuous and an upper plate vertically spaced above the lower plate which has an opening positioned vertically above the continuous lower plate, a first edge of the lower plate being spaced from an adjacent wall of the housing to define a first gap between the first edge and the adjacent wall, the upper plate having a second edge which overhangs the first edge and is spaced closer to the adjacent wall than the first edge.

2. The heat shield of claim 1, wherein the second edge of the upper plate is spaced from the adjacent wall of the housing to define a second gap between the second edge and the adjacent wall, wherein the second gap is smaller than the first gap.

3. The heat shield of claim 1, further comprising three or more tiers of plates in which the lower plate is a continuous plate and the plates in the upper tiers each have an opening surrounded by a continuous edge region defining a second edge which overhangs and extends beyond the edge of the plate below.

4. The heat shield of claim 1, wherein at least the lower plate slopes downwardly in a direction towards the first edge.

5. The heat shield of claim 4, wherein at least the lower plate slopes downwardly from the horizontal at an angle in a range from 5 degrees to 45 degrees.

6. The heat shield of claim 1, wherein the vertical spacing of the plates is configured in dependence on the expected size/quantity an expected size or quantity of the debris required to be discharged.

7. The heat shield of claim 1, wherein the heat shield is configured to protect an exhaust after-treatment system.

8. The heat shield of claim 7, wherein part of the exhaust after-treatment system is located within the opening of the upper tier or tiers.

9. The heat shield of claim 1, wherein an end of the lower plate of the tiered discharge plate arrangement has a flap which extends upwardly to inhibit environmental debris from entering the housing at that end of the discharge plate arrangement.

10. The heat shield of claim 1, wherein the discharge plate arrangement comprises a material selected from the group consisting of metal and plastic.

11. The heat shield of claim 1, wherein the discharge plate arrangement is orientated such that first edge of the lower plate and the second edge of the upper plate are located behind and spaced from a forward-facing wall of the housing.

12. The heat shield of claim 1, wherein the housing is configured to enclose a substantially vertically extending part of the exhaust system.

13. The heat shield of claim 12, wherein the housing is configured to at least partially enclose an exhaust gas after-treatment system (EAT) forming part of the exhaust system.

* * * * *